United States Patent [19]

Raulerson, Jr.

[11] 4,220,523

[45] Sep. 2, 1980

[54] RECOVERING OF PHOSPHATES FROM PHOSPHATE ORE

[75] Inventor: J. D. Raulerson, Jr., Bartow, Fla.

[73] Assignee: Jacobs Engineering Group Inc., Pasadena, Calif.

[21] Appl. No.: 926,558

[22] Filed: Jul. 19, 1978

[51] Int. Cl.[2] ..... B03B 7/00

[52] U.S. Cl. ..... 209/17; 209/166

[58] Field of Search ..... 209/166, 12, 17, 3; 241/20, 24

[56] References Cited

U.S. PATENT DOCUMENTS

| | | | |
|---|---|---|---|
| 2,668,617 | 2/1954 | Houston | 209/12 X |
| 2,931,502 | 4/1960 | Schoeld | 209/166 X |
| 3,137,650 | 6/1964 | Smith | 209/12 |
| 3,145,163 | 8/1964 | Dancy | 209/12 |
| 3,384,310 | 5/1968 | Van Slyke | 209/17 X |
| 3,388,793 | 6/1968 | Dibble | 209/12 X |
| 3,446,443 | 5/1969 | Clark | 209/166 X |
| 3,782,539 | 1/1974 | Painter | 209/166 |
| 3,990,966 | 11/1976 | Stanley | 209/166 |

*Primary Examiner*—Robert Halper

*Attorney, Agent, or Firm*—Donald D. Mon

[57] ABSTRACT

A process for recovering phosphate values from phosphate ore containing phosphates and silica in which scrubbed and screened ore is subjected to a flotation process which floats finer silica particles but not heavier silica particles, and which does not tend to float phosphates, and removing the floated material thereby forming a concentrate while discarding silica fines. The concentrate is next screened to remove components of the ore which are of sizes greater than the sizes of silica particles which will be removed by said flotation, and removing from the process finer particles which are passed by the screen and predominately contain phosphates because the finer silica particles had previously been floated off, and then comminuting the material retained on said screen and reintroducing it to the process.

8 Claims, 1 Drawing Figure

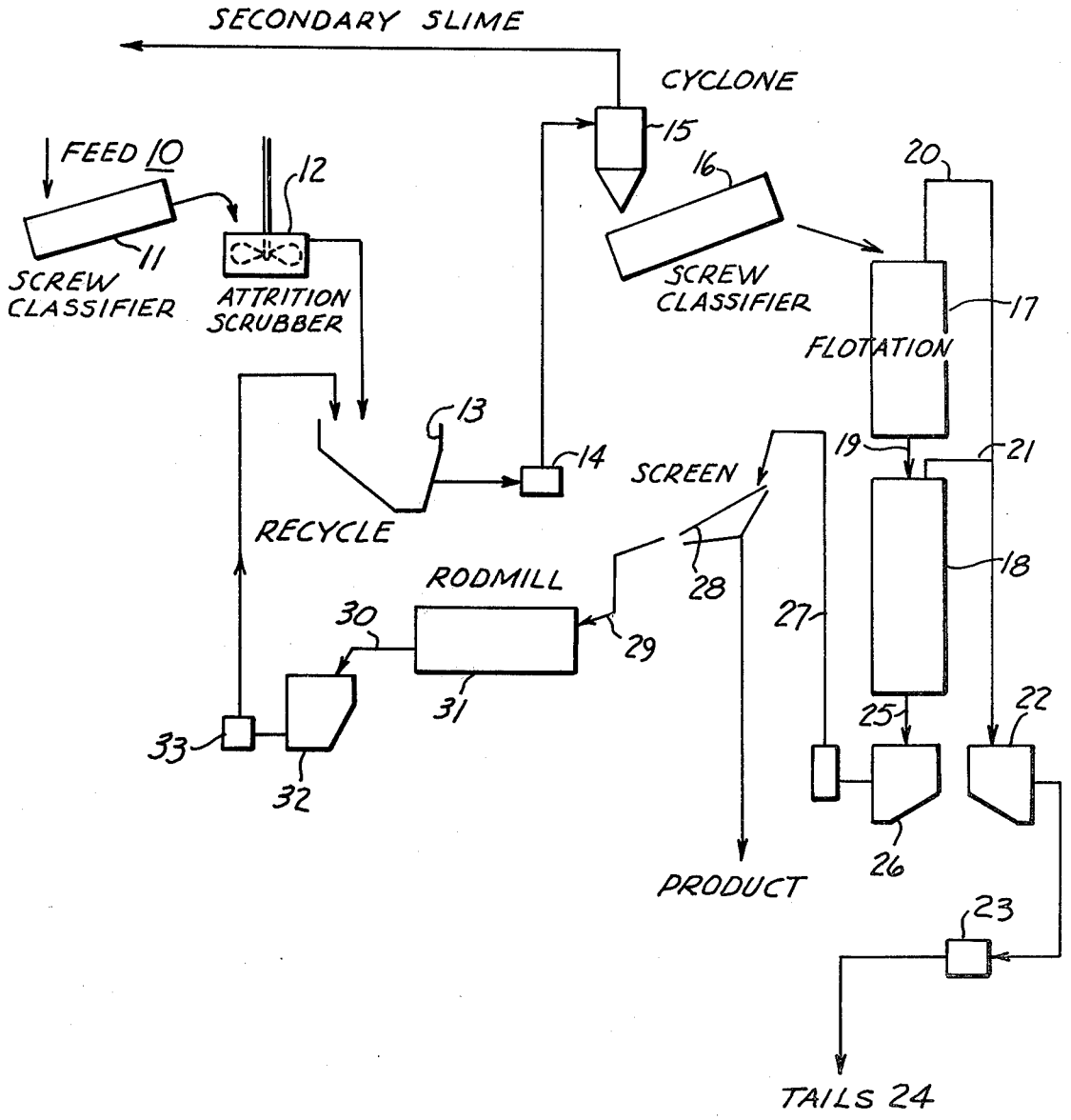
SECONDARY SLIME
CYCLONE
FEED 10
12
15
16
20
11
SCREW CLASSIFIER
ATTRITION SCRUBBER
SCREW CLASSIFIER
17
FLOTATION
13
14
19
21
SCREEN
RECYCLE
28
18
RODMILL
30
29
27
31
22
25
33
32
26
PRODUCT
23
TAILS 24

RECOVERING OF PHOSPHATES FROM PHOSPHATE ORE

This invention relates to recovery of phosphates from phosphate ores of the type which includes phosphates and silica.

The classical process for such recovery is the Craigo process in which a fatty acid type reagent floats the phosphate in a first flotation step, in which the silica is wetted and sinks, and the phosphates float. The floated phosphate is next treated to remove the fatty acid, and then this previously floated material is subjected to an amine flotation process which floats off silica which may have become entrained with the phosphate, and sinks the phosphates which are recovered as product. This is a two-step process which functions best on relatively high grade ore, and for such ores is quite satisfactory. However, it is not optimum for use with lower grade ores. The Craigo process, when operating with 30% BPL feed leaves approximately 6% BPL in the tailings. However, when it is used to process 15% BPL feed, it leaves as much as 4% BPL in the tailings. This is a substantial percentage loss.

It is an object of this invention to process relatively low grade ores such as 15% BPL feed, leaving less than 2% BPL in the tailings. This is a dramatic increase in recovery from low grade ores, and significally lessens the complications of disposing of the tailings.

A further advantage of this invention is that it produces a final concentrate that is composed of all −28 to −35 mesh particles. This fine product can, with no further drying or grinding, be used as a feed to a phosphoric acid digester. The saving in feed preparation cost is a significant amount and represents a major advantage of this invention over the usual practice.

The process according to this invention is accomplished by subjecting scrubbed and screened ore to a cationic flotation process which floats finer silica particles but not coarser silica particles, nor phosphates, nor phosphates. The floated material, principally silica is removed, thereby leaving behind a rougher concentrate. This concentrate is screened to remove components of the ore which are of a size greater than the size of silica particles which are removed by flotation. Thus, both larger and smaller silica particles have been subjected to processes which tend to remove them, but the phosphate particles have not. There are removed from the process as product the finer particles, principally phosphate, which are passed by the screen. The material retained by said screen is then comminuted and returned to the flotation tank for reprocessing.

According to a preferred but optional feature of this invention, the flotation process is accomplished in two or more stages to improve its efficiency.

According to another preferred but optional feature of the invention, the flotation process utilizes an amine reagent.

The above and other features of this invention will be fully understood from the following detailed description and the accompanying drawings in which the single FIGURE shows a flow diagram of the process.

The term "comminution" is used to mean a reduction in size by whatever means is desired to be employed such as fracturing by rod or hammermills, or reduction by other crushers or grinders, to reduce the ore size to useful dimensions. It does not connote any special range of sizes such as powders or very fine particles, but instead connotes the generic process of reduction in size.

The inlet of the process begins with process feed 10 which is supplied to a screw classifier 11 which delivers ore to an attrition scrubber 12. The classifier increases the solids in the feed to a range for effective attrition scrubbing. The material from the attrition scrubber is dumped into a bin 13 from which it is diluted and transported by pumping means 14 to one or more stages of cycloning 15 which deslimes the feed material. Material from the cyclone is fed to a screw classifier 16 which feeds the material to a first flotation tank 17. There is also provided a second similar flotation tank 18. Line 19 shows the transport of concentrate from the first flotation tank to the second flotation tank. Lines 20 and 21 represent means for conveying away the floated material from two flotation tanks to a receiver 22 from which it is transported by conveyer means 23 to a tailings dump 24 or other place to dispose of this material, which is principally silica fines.

Line 25 schematically illustrates means for conveying the concentrate from the second flotation tank to a receiver 26 from which the material is carried by conveyer means 27 to a screen 28.

Line 29 illustrates conveyer means for carrying the material not passed by screen 28 to comminution means 31, such as a rodmill, or hammermill, where the material which does not pass screen 28 will be reduced in size and placed in bin 32 from which it is moved by conveyer means 33 to bin 13, thereby being recycled through the process. This recycled material will constitute various smaller sizes of silica and phosphates, some of which will respectively float off in the flotation tanks, or pass screen 28, respectively.

It will be seen from the foregoing that the process comprises feeding the feed ore to flotation means to separate the silica portion which is discarded as tails, and screening the concentrate to recover as product the material which passes the screen, and recycle material retained on the screen after comminution.

The details of certain portions of this apparatus will now be described. There is no special equipment required in this process. Completely conventional equipment can be used, and therefore the equipment is not described in detail. The feed to the flotation tanks is preferred to be in the size range between about −10 to +150 mesh.

The flotation process is the same in both tanks. A part of the total reagent requirement is added in each tank to increase selectivity. The flotation process utilizes a cationic reagent such as a pure amine for flotation. This amine provides a sharp separation of silica and phosphate. The tank is, of course, filled with water. This process does not float substantial phosphates and does float silica which is not too large in size. In fact, there is no suitable process for floating large size silica particles. Accordingly, it is the objective of this flotation process to remove all silica of sufficient fineness and to pass through as concentrate substantially all of the phosphate and the heavier coarser silica particles. This flotation process is well known to persons skilled in the art and requires no detailed description here.

The concentrate is moved by conventional means to screen 28. This screen preferably passes particles between about 28 mesh and about 35 mesh. Finer sizes will be substantially entirely phosphate with very little silica because silica in this size range will have been floated in the flotation tank. The material remaining on the screen will be larger sizes of phosphate and the larger sizes of silica. It will be seen that the screening has had to be done on less than the total feed, the silica fines having been removed.

Comminution means 31 reduces the size of the retained material, and it is recycled with new feed. Accordingly, the finer sizes of this comminuted material when recycled will be removed as already described. While two flotation steps provide for best recovery, still the process can function effectively with only one, or even more than two flotation steps. It is not necessary to clean up the ore between steps such as required in the Craigo process, because the steps are identical.

Accordingly, it is possible to treat low grade phosphate ore with this process, and the improvement in recovery compared to the prior art is quite dramatic. There is never any intentional substantial flotation of phosphates, even though some will inevitably be entrained in the tailings.

This invention thereby provides a elegant and straightforward technique for recovering phosphate values from ores which contain phosphates and silica, which is at once economical and effective.

This invention is not to be limited to the embodiment shown in the drawings and described in the description, which is given by way of example and not of limitation but only in accordance with the scope of the appended claims.

I claim:

1. A process for recovering phosphate values from phosphate ore containing phosphates and silica comprising:

(a) subjecting said phosphate ore, comminuted, to a flotation process which floats finer silica particles, but not coarser silica particles, and does not tend to float phosphates, and removing the floated materials, thereby leaving behind a rougher concentrate;

(b) screening the rougher concentrate from step (a) to remove components of the ore which are of size greater than the sizes of silica particles which were removed by flotation, and removing from the process the finer product particles which were passed by the screen; and (c) comminuting the material retained on the screen in step (b) and reintroducing it to step (a), the flotation process of step (a) and the screening process of step (b) constituting the only separative operations imposed on said ore from the introduction of said ore to said flotation process to the completion of the removals defined in step (b).

2. A process according to claim 1 in which step (a) is accomplished in two or more stages.

3. A process according to claim 1 in which an amine is used for flotation purposes in step (a).

4. A process according to claim 1 in which the size range of the ore supplied to step (a) is −10 to +150 mesh.

5. A process according to claim 1 in which the size of the screen in step (b) is between about 28 mesh and about 35 mesh.

6. A process according to claim 5 in which the size range of the ore supplied to step (a) −10 to +150 mesh.

7. A process according to claim 6 in which an amine is used for flotation purposes in step (a).

8. A process according to claim 7 in which step (a) is accomplished in to or more stages.

* * * * *